United States Patent [19]

Whike et al.

[11] 4,217,090

[45] Aug. 12, 1980

[54] OVEN HEATING SYSTEM

[75] Inventors: Alan S. Whike, Caledon East; Richard Dusil, Mississauga, both of Canada

[73] Assignee: B & K Machinery International Limited, Malton, Canada

[21] Appl. No.: 935,855

[22] Filed: Aug. 22, 1978

[51] Int. Cl.[2] ..... F27B 9/28

[52] U.S. Cl. ..... 432/8; 432/21; 432/59; 432/72

[58] Field of Search ..... 432/8, 59, 72, 21; 118/68

[56] References Cited

U.S. PATENT DOCUMENTS

| | | | |
|---|---|---|---|
| 2,517,024 | 8/1950 | Prescott et al. | 432/8 |
| 4,140,467 | 2/1979 | Ellison et al. | 432/59 |

*Primary Examiner*—John J. Camby

*Attorney, Agent, or Firm*—George A. Rolston; William F. Frank

[57] ABSTRACT

A strip curing oven apparatus for treating a workpiece carrying a coating containing a vaporizable solvent which is oxidizable to provide at least part of the heat requirement of said oven apparatus and which oven apparatus comprises an oven having a plurality of oven zones, such workpiece being movable through said oven zones in sequence, radiant header means disposed within one said oven zone so as to radiate heat toward a workpiece moving through that oven zone, incinerator means for incinerating oven gases to oxidize solvent vapors contained therein and to discharge such gases, after incineration, at an elevated temperature and with a reduced solvent vapor content, into said radiant header means, first gas-transferring means for transferring oven gases containing untreated solvent vapors from at least one of said oven zones to said incinerator means, oven gas circulation means located in said oven zone containing said radiant header means for circulating oven gases for passage between said radiant header means and an opposed surface of a workpiece moving through said oven, and, second gas transferring means for receiving incinerated gases from said radiant header means and for transferring and discharging such gases into a plurality of said zones of said oven. There is also disclosed a method of curing a coating on a strip workpiece.

13 Claims, 6 Drawing Figures

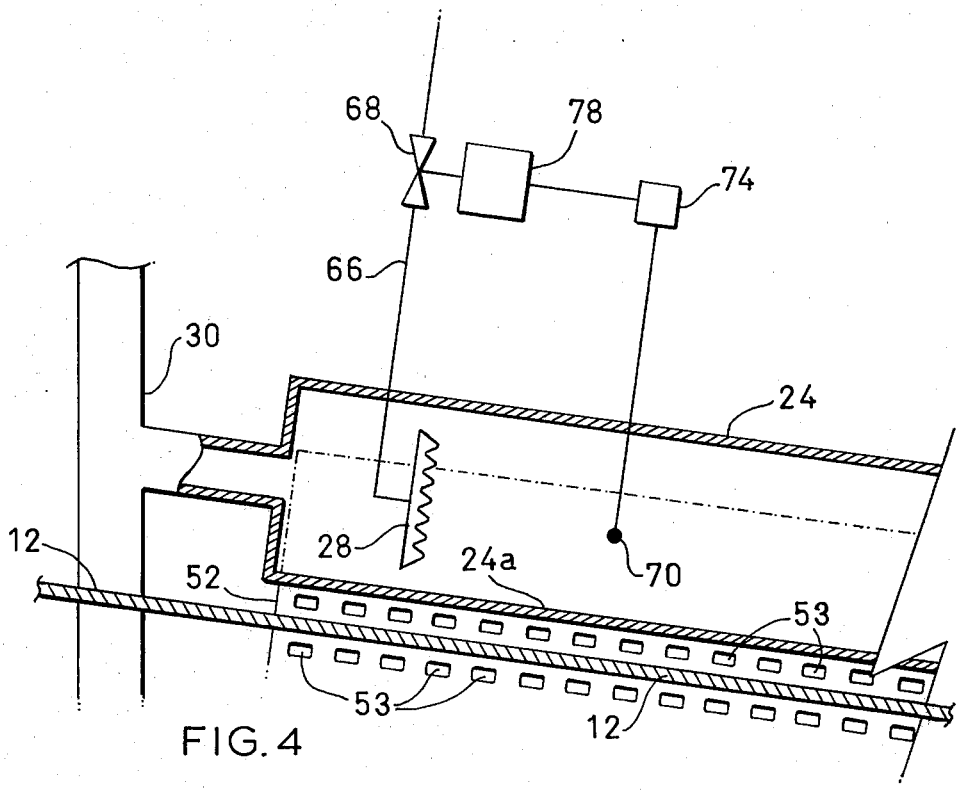
FIG. 4
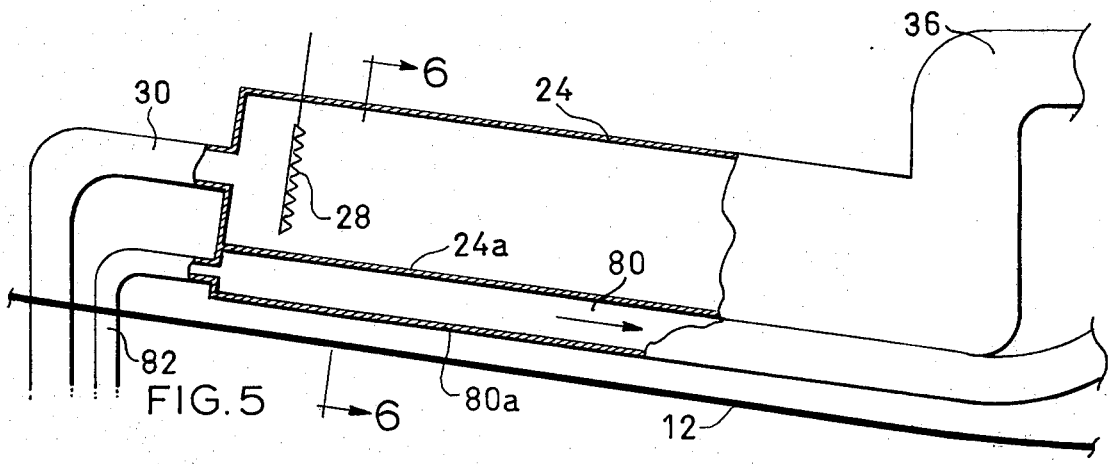
FIG. 5
FIG. 6
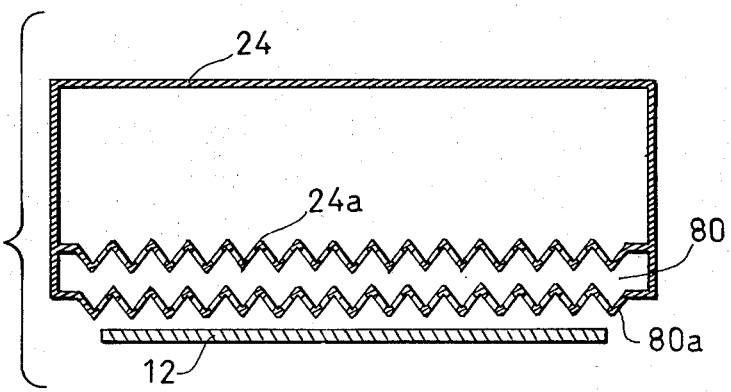

OVEN HEATING SYSTEM

The invention relates to ovens for curing coated strip material, and to a method of curing coated strip material. Ovens for curing coated strip material are required to provide heat for curing the coating on the strip, and at the same time must dispose of volumes of solvent, in the form of solvent vapours, without causing atmospheric pollution.

Preferably the oven will be capable of operating over a fairly wide range of temperatures, and volumes of solvent, and with a variety of different types of solvent. Such solvents are highly inflammable, and it is essential to keep the oven atmosphere a predetermined concentration of the solvent, while at the same time maintainng a termperature range suitable for the curing of the particular type of coating being applied. Coatings may vary from paint, to rust-proofing materials to adhesives. Preferably, the speed of operation of the entire coating line will be as high as is practically possible, and in order to achieve such operating speeds without enormously increasing the length of the oven, it is necessary to apply the heat required for curing in a carefully regulated and progressive manner. For this reason such an oven is customarily arranged in sequential zones. It is found that the greatest volumes of the solvent vapor are evaporated in the first and second zones of an oven which may have anywhere from four to six zones, or at all events within approximately the first one quarter to one third of the entire length of the oven. In order to maintain the solvent vapour concentration in the zones of high vapour release, at or below the limit for the particular solvent, it is necessary to provide a greater degree of ventilation of that part of the oven, than is required in the zones of the oven further downstream where the rate of solvent evaporation becomes progressively less.

Conversely, the zone temperatures in the first and second zones are usually somewhat lower and the temperature in the subsequent zones downstream are usually somewhat higher so as to provide a progressive and rapid cure of the coating without boiling off the solvent too rapidly.

It is desirable that both of these somewhat conflicting requirements shall be met, while keeping the admission of fresh air to a minimum. In addition, solvent vapours cannot be vented to atmosphere untreated, and are normally incinerated in an exhaust stack after burner, requiring extra fuel. In order to reduce the fuel consumption numerous proposals have been made for incinerating the oven exhaust and some of the incinerated gases are returned to the oven. Some of the heating values of such solvent vapours are thus returned to or retained within the oven to maintain the oven temperature thereby somewhat reducing the fuel input.

However, the incineration of the oven exhaust, and the return of such incinerated gases within the oven system presents certain conflicting problems.

In order to prevent pollution, incineration must be carried out at very high temperatures. Special alloys must then be used for fans, ductwork, dampers, etc. for recycling of such gases, and the cost is such that it is often uneconomic.

One proposal has been to provide separate individual zone incinerators, incinerating oven gases and discharging directly back into the zones. These incinerators operate at somewhat lower temperatures, and avoid the need for costly external high temperature ducting and controls.

A separate stack afterburner operating at a higher temperature incinerates and oxidizes exhaust gases prior to release in the atmosphere.

While the use of separate zone incinerators does provide a satisfactory answer to most of the problems, and does achieve major fuel savings, it is a relatively costly installation.

It will be understood that many oven installations are already in existence which are operating in a highly inefficient manner, consuming considerably more fuel than is actually required and operating at speeds below maximum efficiency.

In the interest of fuel economy it is highly desirable that such inefficient installations be improved. However, it is not economically practical to write off such inefficient installations and build new ones. Accordingly, it is highly desirable that such inefficient installations may be upgraded and improved to the efficiency to a new operation, simply by fitting improved duct work and incinerators within the existing oven, while utilizing as far as possible the existing structure, with a minimum of disruption.

In some cases the cost factor, and installation time, rule out the use of multiple zone incinerators, and extensive alterations in ductwork, and some simpler yet equally effective solution is desirable.

BRIEF SUMMARY OF THE INVENTION

The invention seeks to overcome many of the foregoing disadvantages, by the adoption of the following general principles.

1. Install two modified zone incinerators, one above and one below the strip, located in the first oven zone.
2. Install radiant header ducts above and below the strip, connected with the incinerators and pass the hot incinerated gases through such radiant headers above and below the strip to produce radiant heating of the strip, without causing harmful effects on the coating.
3. Pass the slightly cooled incinerated gases from the radiant headers, through further duct work downstream within the oven, and release the gases in subsequent oven zones to contribute to the heat requirements of the downstream zones.
4. To maintain oven balance, remove oven gases from those subsequent zones and return them to zones one and two for greater zone ventillation in the area of greatest solvent evaporation.
5. Pass some of the upstream gas flow in a direction between the radiant headers and both sides of the strip as it passes between the radiant headers, so as to maximise ventilation of solvent evaporated from the strip.
6. Withdraw a minimum of oven gases to maintain oven balance from zone two and exhaust the same to atmosphere, through a separate exhaust incinerator, and admit a minimum of fresh air at the entrance and exit ends of the oven only.
7. Continuous circulation of oven gases within each zone by means of typical zone circulation fans and duct work, and maintain fine regulation of zone temperatures in zones two, three, four, five etc. by means of supplementary zone burners in each zone.

Following these principles, it is possible to modify and refit a typical existing oven installation, so as to reduce fuel consumption, increase the strip speed, and provide a cleaner atmosphere exhaust. Because the major portion of the refitting work is carried out only in the region of zone one, the actual refitting time required is reduced to a minimum, or in any event, to only a fraction of what would be required to rebuild an existing oven using separate zone incinerators. This significantly reduces the overall installation costs, and ensures that down time and lost production are kept to a minimum.

It is particularly noteworthy that the use of radiant headers located above and below the strip in zone one, enables the hot incinerated gases from the two incinerators to be used in providing radiant heating of the strip in this region, where actual direct heating by the hot gases themselves would produce too high a temperature and result in improper curing of the coating.

In addition, the location of such incinerators in zone one permits continuous, rapid incineration of solvents from the region of highest solvent release thereby maintaining solvent concentration within safe limits without the need for ducting large volumes of solvent-rich oven gases to incinerators at most distant location.

The discharge of the incinerated gases in the downstream zones provides an oven atmosphere which is well below the safe L.E.L. levels of solvent, in these zones. In addition such incinerated gases help to maintain these zones at the desired higher temperature levels. Any adjustment of temperatures in these zones can be carried out by the existing zone burners, which are customarily used in existing ovens as the primary heating source for each zone.

Recycling of the oven gases circulating in zones 3, 4, 5 etc. back into zones 1 and 2 achieves two things namely it provides zone ventilation gases which are more or less solvent free or at least in which the solvent vapour concentration is fairly low, and maximises ventilation where it is needed.

It will be understood that the operation of the oven incinerators is such as to oxidize a major portion of the solvent vapours, but is not intended to achieve complete oxidation of the solvent vapours as would be required if the gases were discharged to atmosphere, since all of the incinerated gases are returned directly into the various zones.

Any oven gases being exhausted to atmosphere pass through a separate exhaust incinerator or afterburner operating at a higher temperature to produce a complete environmentally acceptable oxidation of the solvent vapours.

A heat exchanger will normally be incorporated in the exhaust stack, for heat recovery, and the heat recovered may be used to satisfy other process heat demands or to heat the interior of the building or alternatively may be used to preheat incoming plant air.

Where the temperature in the radiant header is too great for the workpiece and its coating, then a heat transfer duct or channel may be provided between the radiant header and the workpiece. Lower temperature gases, i.e. gases at regular oven temperature may be passed through such a duct. In this way some of the heat from the radiant header will simply heat such gases in the duct and will be transferred to other regions in the oven.

The invention comprises a heat treatment oven apparatus for treating a workpiece carrying a coating containing a vapourizable solvent which is oxidizable to provide at least part of the heat requirement of said oven apparatus and which oven apparatus comprises, an oven having a plurality of oven zones, such workpiece being movable through said oven zones in sequence, a radiant header disposed within one said oven zone so as to radiate heat toward a workpiece moving through that oven zone, an incinerator for incinerating oven gases to oxidize solvent vapours contained therein and to discharge such gases, after incineration, at an elevated temperature and with a reduced solvent vapour content, into said radiant header, a first gas-transferring means for transferring oven gases containing solvent vapours from one of said oven zones to said incinerator, a workpiece cooler located in said oven zone containing said radiant header for supplying oven gases for passage between said radiant header and an opposed surface of a workpiece moving through said oven to avoid overheating, a second gas-transferring means for transferring oven gases from one of said oven zones to said workpiece ventilating opening, and incinerated gas transfer means for receiving incinerated gases from said radiant header and for transferring and discharging such gases into a plurality of said zones of said oven.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 4 is a section along the line 4—4 of FIG. 2;

FIG. 5 is a schematic side elevation of a further embodiment, and

FIG. 6 is a section along the line 6—6 of FIG. 5.

DESCRIPTION OF A SPECIFIC EMBODIMENT

Figure 1:
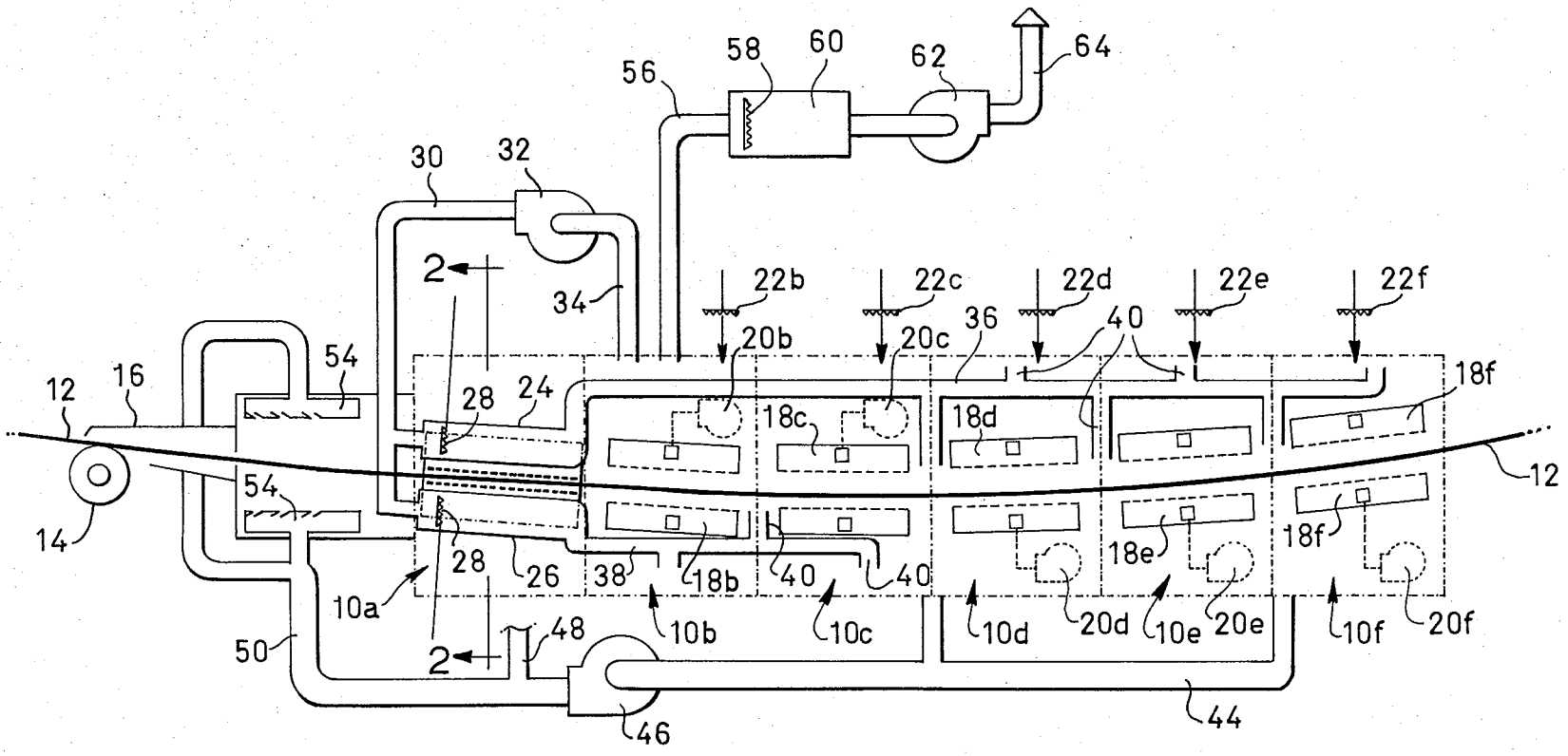
FIG. 1 is a schematic side elevational view showing a strip curing oven according to the invention.
Figure 2:
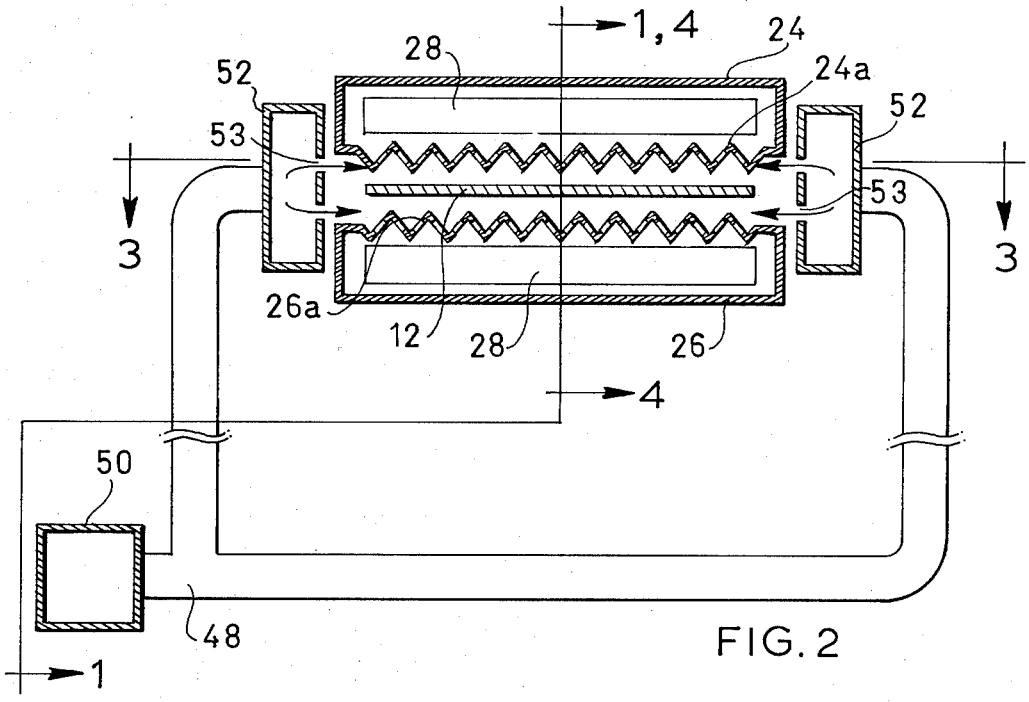
FIG. 2 is a section along the line 2—2 of FIG. 1.
Figure 3:
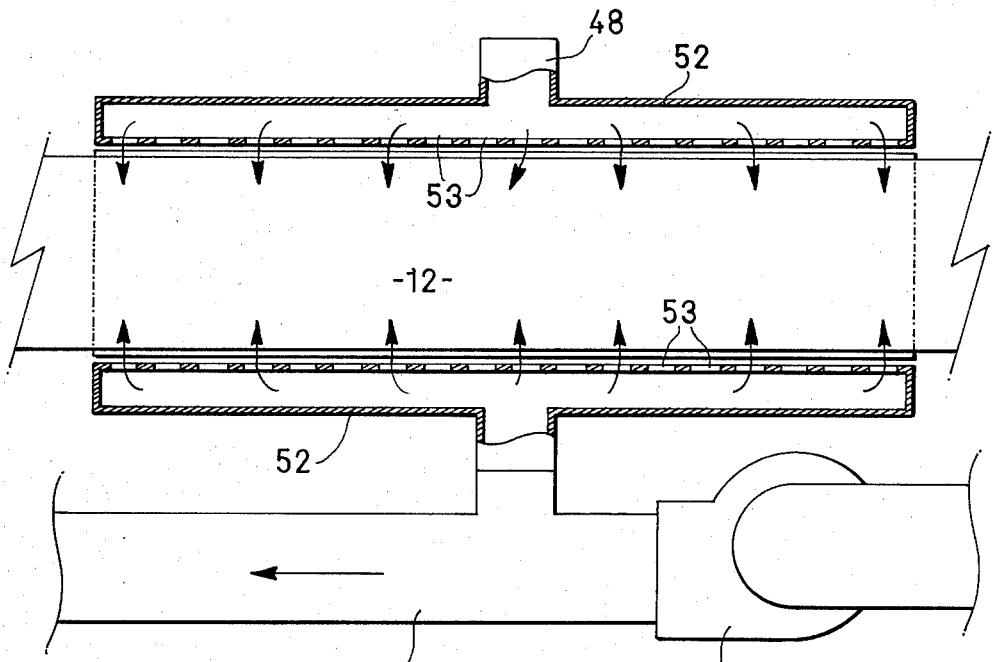
FIG. 3 is a section along the line 3—3 of FIG. 2.

Referring now to FIG. 1, it will be seen that the oven indicated generally as 10 consists of a plurality of oven zones 10*a, b, c, d, e,* and *f,* with the strip 12 passing from left to right that is to say through zones A–F in sequence. Zone 10*a* is thus the first oven zone, and the remaining zones B–F are subsequent oven zones.

It will however be appreciated that ovens in many cases are not precisely divided up into zones that are separately identifiable as such. In many cases, the oven consists of a single continuous chamber, with various ducts fans and the like and heaters being located along its length, with the curing treatment taking place in a gradual progressive manner along the length of the oven. It is however convenient, and conventional in the art, to consider the oven as if it consisted of a series of separate zones, and for the purposes of the present application, the zones will be referred to in this manner, although it will be appreciated that they are in most cases all contained within a single continuous chamber or housing constituting the entire oven enclosure.

The strip 12, which is in the majority of cases strip sheet metal, will first of all have been coated in a coater room, usually with an anti-corrosion coating, or with a paint layer, on rotary coater equipment, indicated schematically by the single roll 14 on one side or both. It will of course be appreciated that the coater equipment is relatively complex and consists of a multiplicity of such rolls, only one being shown for the sake of clarity.

In the present embodiment of the invention, the oven zones 10*b*, 10*c*, 10*d*, 10*e* and 10*f* are all provided with individual zone gas recirculating systems comprising upper and lower ducts 18*b*, 18*c*, 18*d*, 18*e* and 18*f*, and individual zone recirculating fans, shown as 20, of which only fans 20*d* and 20*e* are shown for the sake of simplicity.

The function of the ducts 18 and the fans 20, is to maintain a continuous turbulent flow of zone gases over and around both sides of the strip 12 as it passes through the various zones, so as to produce rapid curing of the coating, and entrainment of solvent vapours evaporating in such zones.

The individual zones 10*b*, 10*c*, 10*d*, 10*e* and 10*f* are also supplies with individual zone heaters 22, which are typically gas fired burners, for supplying supplementary heat to the individual zones.

It will be appreciated that in the case where the present invention is installed as a "retro fit" installation, in a typical existing oven structure, the individual zone recirculating ducts and fans 18 and 20, and zone heaters 22 will usually already be present in the oven, or at least some eqivalent circulating and back up heating will be present. If however it should be desired to employ the invention in the construction of a new installation, then of course such equipment would form part of the new structure.

In the majority of prior art ovens, the first zone namely zone 10*a* would also be provided with a zone recirculation system and heater and this will have been removed during the "retro fit" operation. In accordance with the invention, the major heat source in zone 10*a* is radiant heat, so as to heat the strip itself before heating the coating. Such radiant heating is carried out by means of upper and lower radiant duct work identified as 24 and 26, arranged above and below the path of the strip as shown, and extending along the length of the first zone 10*a*, and having a width slightly in excess of the width of the strip 12, incinerators 28 are located in duct work 24 and 26, directed to fire in a downstream direction, i.e. along the length of the strip 12. The portions 24*a*, 26*a* of ducts or headers 24, 26 facing the workpiece are corrugated to increase the radiant area, and thus the heating effect.

Solvent rich oven gases are supplied to the upstream ends of upper and lower radiant ducts 24 and 26 by means of the supply duct 30, and fan 32, and fan 32 is in turn connected to a point approximately between zones 10*a* and 10*b*, by means of a duct 34. Operation of fan 32 thus withdraws solvent rich oven gases from zones 10*a* and 10*b*, and forces them back through duct 30 into the upstream ends of radiant ducts 24 and 26. As such oven gases pass around the incinerators 28, the solvent vapours will be oxidized, or at least a major proportion thereof will be oxidized, and at the same time the oxidized gases will then be at an elevated temperature. For example, the solvent rich gases entering the radiant duct 24 and 26 may be at temperatures in the region of 400°-600° fahrenheit, and after passage through the incinerators 28, the gases may be at temperatures in the region of 900°-1100° fahrenheit.

Gases at these elevated temperatures would be too hot discharge directly around the strip 12, especially in zone one, where the heat must be applied in a gradual and progressive manner. Accordingly, the gases are passed directly down the radiant duct work 24 and 26, and some of the heat from such elevated temperature gases will be lost to the duct walls, and will be radiated outwardly into zone 10*a*. The strip 12 passing between the ducts 24 and 26 will thus be subjected to radiant heating which will heat up the strip sheet metal, and thus heat up the coating applied thereto. Such heating will thus tend to vaporize solvents in the coating at a rapid rate, resulting in a fast progressive curing of such coating.

In order to remove the high temperature oxidized gases from the radiant duct work 24 and 26, and to redistribute the same down the length of the oven, through subsequent oven zones 10*b* to 10*f*, respective upper and lower downstream transfer ducts 36 and 38 are provided. Ducts 36 and 38 are located some distance away from the strip 12, so as to fit around the individual zones circulation ducts 18, and yet be located within the fabric of the oven 10. In this way, further heat will be radiated from such ducts 36 and 38 directly into the zone gases circulating in the zones. In addition, at intervals along the length of the oven 10, various outlets 40 are provided, for discharging some of the high temperature gases in the various zones, for the purpose of mixing with the zone gases circulating in the zones. The effect of this is two fold. In the first place the zone gases are mixed with the higher temperature oxidized gases thereby maintaining stable zone temperatures. Secondly, the oxidized gases, being to a large extent free of solvent vapours, when mixed with the zone gases, will tend to maintain a stable solvent vapour percentage in such zone gases, thereby avoiding a dangerous build up of solvent vapours.

It will of course be appreciated that the various outlets 40 in the ducts 36 and 38 may be provided with suitable dampers or controls, by means of which the volumes of gas discharged in each particular zone may be regulated.

In order to balance the volumes of gases in the various oven zones, oven gases are extracted from the oven through ducts 42 and 44, by means of fan 46. Such gases are then distributed by means of ducts 48 and 50, to upstream portions of the oven, to provide greater oven ventilation, in zones of high volumes of solvent vapour. Gases in duct 48 are supplied to one or a pair of elongated distribution headers 52 located in zone 10*a* alongside and to one side of the radiant duct work 24 and 26. Headers 52 are oriented along the side of strip 12, and have gas outlets 53 by means of which gas flow may be directed transversely over the upper and under surfaces of the strip 12. In this way, turbulent gas flow is maintained over both surfaces of the strip 12 as it passes between the radiant ducts 24 and 26 thereby ensuring that the solvent vapours evaporated therefrom are rapidly entrained and carried away.

Gases flowing into duct 50, are supplied to oven entry headers 54 located above and below the strip 12, in the oven extension portion 16. As described in the aforesaid application Ser. No. 836,522, filed Sept. 26, 1977, now U.S. Pat. No. 4,136,636 gas outlets are provided in the headers 54 (not shown) whereby gas flow is directed at an angle towards the strip, and downstream in the same direction as the direction of movement of the strip 12. In this way, an inward gas flow is developed, towards the interior of the oven 10, and fresh air will be inducted by such inward gas flow, from the coater room, thereby entraining any solvent vapours evaporated around the coater 14, and drawing such solvent vapours into the oven, where their thermal values may be utilized.

At the same time, since the gases are at an elevated temperature, they will at least maintain a moderately elevated temperature in these regions thereby avoiding possible problems of solvent vapour condensation.

In order to maintain a sufficient inflow of fresh air to supply the oxygen in the oven gases required to support oxidation of the solvent vapours by the incinerators 28, a sufficient volume of oven gases is exhausted to atmosphere, by means of exhaust duct 56. In the case of this particular embodiment, these exhaust gases are then passed through the high temperature exhaust gas incinerator 58. The oxidized high temperature gases are then passed through a heat exchanger 60, so as to reduce the gases to a predetermined regulated temperature range usually in the region of 450° fahrenheit, after which they pass through fan 62, and are vented to atmosphere via stack 64.

In order to control the operation of the incinerators 28, they are supplied with primary fuel, usually natural gas through a supply line 66 controlled by a flow control valve 68. The operation of both incinerators 28 is the same although only one is shown for the sake of clarity.

Temperature sensors 70 are provided in the interior of incinerators 28.

Each sensor is connected to respective signal generators 74, which in turn are connected to a respective signal generators 76 responsive, which in turn drive servo drives 78 for controlling the valves 68.

In some circumstances, the heat generated by the incinerators 28 and the radiant ducts 24 and 26 may be such that the heat radiated onto the strip 12 is too intense, with the result that the coating would be damaged.

In such circumstances, it may be desireable to provide an additional heat transfer duct 80, alongside radiant ducts 24 and 26, on either side of the strip 12.

In FIGS. 5 and 6 only one such radiant duct 24 is shown and only one such heat transfer duct 80 is shown. It will however be appreciated that in the majority of cases where required, there would be two such heat transfer ducts 80, one being associated with radiant duct 24 and the other being associated with the radiant duct 26. The portion 80*a* of duct 80 will also be corrugated to increase the radiant area.

The distribution headers 52 are omitted from FIGS. 5 and 6 but it will be understood that such headers 52, or other suitable ventilation means, will be provided for directing oven gases over both surfaces of the strip workpiece, as it passes between ducts 80.

Lower temperature oven gases are supplied through the duct 80 by means of the supply pipe 82, fed by any suitable fan means such as fan 46 of the FIG. 1, drawing oven gases from another location in the oven.

Alternatively, it could of course be supplied by means of an entirely separate fan if desired.

The downstream end of the transfer ducts 80 may simply discharge into any one of the zones.

By this means, the heat readiating from the radiant headers 24 and 26 will be at least partially carried away by lower temperature gases flowing down the transfer ducts 80.

The balance of such heat from the radiant headers will then be radiated onto the strip 12, and will also be radiated directly through the other three walls of the headers 24 and 26 into the oven atmosphere within the zone.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A strip curing oven apparatus for treating a workpiece carrying a coating containing a vapourizable solvent which is oxidizable to provide at least part of the heat requirement of said oven apparatus and which oven apparatus comprises:

an oven having a plurality of oven zones, such workpiece being movable through said oven zones in sequence;

radiant header means disposed within one said oven zone so as to radiate heat toward a workpiece moving through that oven zone;

incinerator means for incinerating oven gases to oxidize solvent vapours contained therein and to discharge such gases, after incineration, at an elevated temperature and with a reduced solvent vapour content, into said radiant header means;

first gas-transferring means for transferring oven gases containing untreated solvent vapours from at least one of said oven zones to said incinerator means;

oven gas circulation means located in said oven zone containing said radiant header means;

duct means forming part of said oven gas circulation means and located along at least one edge of the workpiece and having outlets arranged to direct oven gases between said radiant header means and an opposed surface of a workpiece moving through said oven, and, second gas transferring means for receiving incinerated gases from said radiant header means and for transferring and discharging such gases into a plurality of said zones of said oven.

2. A strip curing oven as claimed in claim 1 wherein said radiant header means comprise upper and lower elongated radiant chambers, mounted above and below the path of the workpiece, and having upstream and downstream ends, and wherein said incinerator means comprises upper and lower incinerators, mounted in respective said radiant header means, adjacent the upstream end thereof, and arranged to fire along the length of said chamber means in a generally downstream direction, whereby hot incinerated gases will flow along the length of said chamber, thereby causing the same to radiate heat towards and around said workpiece.

3. A strip curing oven as claimed in claim 2 wherein said second gas transferring means comprises upper and lower transfer ducts connected respectively to the downstream ends of said upper and lower elongated chambers, and connected with a plurality of gas outlets located downstream in said oven, whereby hot incinerated gases will pass from said chambers into said duct work, and be released in downstream zones of said oven.

4. A strip curing oven as claimed in claim 3 wherein said radiant header means are disposed within an upstream one of said zones, relative to the direction of movement of said workpiece through said zones, and wherein said first gas transferring means comprises duct work, connected between at least one downstream one of said zones and an inlet of said incinerator means in said upstream one of said zones, whereby untreated gases are continuously removed from said downstream one of said zones, passed through said incinerator and radiant header means, and then transferred therefrom as incinerated gases, said incinerated gases being at a higher temperature, whereby to mix with oven gases in said downstream one of said zones, thereby supplying at least part of the heat input required in said downstream one of said zones.

5. A strip curing oven as claimed in claim 4 wherein said first gas transferring duct work is connected with a downstream zone next adjacent to said zone containing said radiant header means, and including oven gas exhaust duct means connecting with said downstream one of said zones, and exhaust gas incinerator means, for treating gases from said downstream one of said zones, prior to discharge to atmosphere.

6. A strip curing oven as claimed in claim 1 wherein said duct means comprise oven gas ventilation ducts extending longitudinally along either side of the path of said workpiece, adjacent said radiant header means, opening means in said oven gas ventilation ducts, whereby to direct oven gases substantially transversely of said workpiece over at least one surface thereof between said radiant header means and said at least one surface of said workpiece and gas supply duct means connected therewith, for supplying oven gases to said ventilation ducts for distribution as aforesaid.

7. A strip curing oven as claimed in claim 6 wherein said radiant header means are of predetermined length, and are located above and below the path of said workpiece, whereby to supply radiant heat to both upper and under surfaces thereof, and wherein said gas ventilation ducts are located on either side of the path of said workpiece, along the length of said radiant header means, and wherein said openings are arranged whereby to direct gas flow between said radiant header means and said workpiece over both surfaces thereof, thereby entraining solvent vapours evaporated therefrom.

8. A strip curing oven as claimed in claim 1 wherein said duct means comprise gas circulation ducts located between said radiant header means and the path of said workpiece, and discharge means located downstream thereof, and gas supply duct means connected thereto whereby oven gases may be passed through said gas circulation ducts and absorb at least some radiant heat from said radiant header means, with said heated oven gases being discharged downstream.

9. A strip curing oven as claimed in claim 8 wherein said radiant headers means comprises upper and lower elongated radiant chambers, mounted above and below the path of the workpiece, and having upstream and downstream ends, and wherein the incinerator means comprises upper and lower incinerators, mounted in respective said radiant header means, adjacent the upstream end thereof, and wherein said gas circulation ducts comprise elongated relatively narrow upper and lower ducts formed integrally with respective upper and lower chambers and there being one wall common to both said cut and said chamber, whereby heat may be transferred to gases in said ducts.

10. The method of curing a coating on a strip workpiece carrying said coating and said coating containing a vapourizable solvent which is oxidizable to provide at least part of the heat requirement for said curing process, said process comprising the steps of;

passing said strip in sequence through an oven containing a plurality of sequential zones, comprising an upstream zone, and sequential downstream zones;

continuously circulating gases within said zones at an elevated temperature whereby to vapourize said solvent and entrain said vapourized solvent in said oven gases;

continuously extracting portions of said oven gases from at least one of said zones, and transferring the same to said upstream zone;

continuously incinerating said transferred gases in incineration means located in said upstream zone;

passing said incinerated gases, at an elevated temperature, through radiant header means located adjacent the path of said strip workpiece, whereby to radiate at least some of the heat from said incinerated gases towards said workpiece;

continuously transferring said incinerated gases from said header means to at least one of said downstream zones, and discharging the same in said zone;

continuously circulating a portion of oven gases from one of said zones, and, continuously circulating said portion of gases through circulation ducts arranged to direct such gases along either edge of said strip, and ejecting same through openings between said radiant header means and an adjacent surface of said workpiece, said gases passing through the spacing therebetween, transversely relative to the axis of said strip.

11. The process for curing a workpiece as claimed in claim 10 including the steps of incinerating said oven gases transferred from said downstream zones, in incinerator means located both above and beneath the path of said workpiece, and continuously passing said incinerated gases from said incinerator means through radiant header means located above and below the path of said workpiece, whereby to radiate heat towards said workpiece from both above and below its path of movement in said oven.

12. The process for curing a workpiece as claimed in claim 11 including the step of continuously extracting oven gases from said oven, and ejecting the same transversely across the path of said workpiece between said radiant header means whereby to entrain solvent vapours vapourized from said coating by radiant heating.

13. The process for curing a workpiece as claimed in claim 11 including the step of continuously extracting oven gases from said oven, and passing them longitudinally down duct work located between said radiant header means and said workpiece, whereby to collect at least part of the heat from said incinerated gases in said radiant header means, and continuously transferring said oven gases from said duct work to at least one downstream zone in said oven.

* * * * *